US006164862A

United States Patent [19]

Takaguchi

[11] Patent Number: 6,164,862

[45] Date of Patent: Dec. 26, 2000

[54] CONTAINER COUPLING TOOL

[75] Inventor: Hiroyuki Takaguchi, Nagasaki, Japan

[73] Assignee: Taiyo Seiki Iron Works Co., Ltd., Osaka, Japan

[21] Appl. No.: 09/059,442

[22] Filed: Apr. 14, 1998

[30] Foreign Application Priority Data

Apr. 16, 1997 [JP] Japan ..... 9-099055
Apr. 16, 1997 [JP] Japan ..... 9-099056

[51] Int. Cl.[7] ..... B65D 21/02

[52] U.S. Cl. ..... 403/325; 403/385; 24/287; 410/83

[58] Field of Search ..... 24/287; 410/73, 410/76, 82, 83; 403/49, 321, 325, 322.1, 322.4, 385, 396

[56] References Cited

U.S. PATENT DOCUMENTS

| | | | |
|---|---|---|---|
| 3,386,696 | 6/1968 | Duval | 24/287 |
| 3,682,423 | 8/1972 | Scarborough | 410/83 |
| 3,724,796 | 4/1973 | Hawkins et al. | 410/83 |
| 3,752,511 | 8/1973 | Racy | 24/287 |
| 4,026,596 | 5/1977 | Carr | 410/82 |
| 4,507,032 | 3/1985 | Rosaia | 410/83 |
| 4,564,984 | 1/1986 | Takaguchi | 24/287 |
| 4,732,505 | 3/1988 | Gloystein | 403/14 X |
| 4,782,561 | 11/1988 | Hayama | 24/287 |
| 5,062,752 | 11/1991 | Takaguchi | 411/347 X |
| 5,160,224 | 11/1992 | Schwiebert | 410/82 |
| 5,193,253 | 3/1993 | Janke et al. | 24/287 |
| 5,791,808 | 8/1998 | Nyholm | 403/325 |

FOREIGN PATENT DOCUMENTS

| | | | |
|---|---|---|---|
| 3613538 | 10/1987 | Germany | 410/82 |
| 3642399 | 6/1988 | Germany | 410/82 |
| 5-23514 | 6/1993 | Japan . | |

*Primary Examiner*—Lynne H. Browne
*Assistant Examiner*—John R. Cottingham
*Attorney, Agent, or Firm*—Wenderoth, Lind & Ponack, L.L.P.

[57] ABSTRACT

A container coupling tool having a handle for disengaging top and bottom cones which is less likely to be turned in the wrong way. The coupling tool has a tool body having a first protrusion and a second protrusion and is formed with a bore extending therethrough from the top face of the first protrusion to the bottom face of the second protrusion. A rotary shaft is inserted in the bore. The tool body is further formed with a handle inserting hole in which is inserted a handle shaft having a lever at its outer end. A motion converter is provided between the handle shaft and the rotary shaft. By pushing up the lever, the top cone can be disengaged, and by pulling down the lever, the bottom cone can be disengaged. Thus, the lever cannot be turned in the wrong way by mistake. A stopper is inserted in a stopper inserting hole formed in a flange of the tool body. The stopper is adapted to abut one of two projections provided on the rotary shaft to prevent the top cone from turning to the disengaged position, thereby preventing the container coupling tool from dropping out of a container hung in the air when the coupling tool is coupled to the bottom of the container.

7 Claims, 11 Drawing Sheets

CONTAINER COUPLING TOOL

BACKGROUND OF THE INVENTION

This invention relates to a container coupling tool for coupling two shipping containers stacked one on the other.

In transporting many shipping containers by sea, they are stacked one on another, each container is coupled to the containers immediately above and below by container coupling tools, and the top containers are fixed to the ship deck by tightening fixing tools connecting the top containers to deck fixtures mounted to the ship deck by means of turnbuckles.

Such a container coupling tool is disclosed in examined Japanese utility model publication 5-23514. This coupling tool includes a tool body having top and bottom cones which can be turned to their respective engaged and disengaged positions by pivoting a handle supported on the tool body.

Two containers are coupled together by the container coupling tools in the following manner. With one container hung in the air, the top cones of coupling tools are inserted and engaged in holes formed at the four bottom corners of the container. With the coupling tools engaged in the holes in the bottom of the container, this container is placed on the other container to let the bottom cones slide into holes formed at the four top corners of the lower container. While the bottom cones are sliding into the holes, each bottom cone turns to its disengaged position by contact with the inner peripheral edge of the hole. When the bottom cone is completely inserted into the hole, it is turned back to the engaged position by a spring. The bottom cones thus engage in the holes of the lower container.

To unload the upper container, the bottom cone of each tool is disengaged from the container hole by pivoting the handle, and the upper container is raised with bottom cones disengaged from the holes of the lower container. When the upper container is lowered to a level at which the coupling tools are accessible to an operator, the operator pivots the handle of each tool to disengage the top cone from the container hole and remove the tool from the container.

With the conventional container coupling tool, the top and bottom cones are turned to their disengaged positions by pivoting the handle to the right or left, respectively. If an operator does not know which way to pivot the handle to disengage the bottom cone, he may pivot the handle in the wrong direction and disengage the top cone in an attempt to disengage the bottom cone.

For example, he may pivot the handles of the coupling tools all to the left, thus unknowingly disengaging the top cones, instead of the bottom cones. When the upper container is raised in this state, the coupling tools will be left on top of the lower container. To remove them, an operator has to climb onto the top of the lower container. This results in a waste of time and labor.

Containers are usually stacked in many tiers. Thus, some coupling tools are located at high levels. To disengage the bottom cones of such coupling tools, an operator on the deck has to pivot the handle of each tool to the left by using a special tool having a long rod. A skilled hand and a special tool are needed to pivot a handle at such a high level in a horizontal direction. Whether or not coupling tools are in engagement has to be judged by checking which way the handle is oriented. But it is extremely difficult to check the orientation of the handle from the deck.

A first object of this invention is to provide a container coupling tool which can minimize the possibility of wrong operation of the handle for disengaging the top and bottom cones.

A second object of this invention is to provide a container coupling tool which can be used is an upside down orientation.

SUMMARY OF THE INVENTION

According to this invention, there is provided a container coupling tool comprising a tool body having a flange for maintaining a predetermined space between two containers stacked one on the other, and a pair of positioning protrusions provided over and under the flange and shaped and sized so as to snugly fit in substantially rectangular holes formed in corner fixtures of the two containers. The tool body has a bore extending therethrough from the top surface of one of the protrusions to the bottom surface of the other of the protrusions. A rotary shaft is received in the bore and has at its top and bottom ends a top cone and a bottom cone which can engage the holes formed in the containers. A spring is mounted so as to be expanded when the rotary shaft is rotated in either direction from an engaged position in which both ends of the top and bottom cones protrude from the perimeter of the top and bottom protrusions, respectively, as view top or bottom of the tool body, to bias the rotary shaft back to the engaged position. A handle has a handle shaft that is inserted in a hole formed in the tool body so as to extend horizontally from the outer periphery of the flange to the bore. The handle also includes a lever extending laterally from the outer end of the handle shaft. A motion converter means is provided for transmitting the rotation of the handle shaft to the rotary shaft such that when the lever is pushed up, the top cone is turned to a disengaged position, and when the lever is pulled down, the bottom cone is turned to a disengaged position.

Since the handle is an L-shaped member comprising the handle shaft and the lever is coupled to the outer end of the handle shaft, the orientation of the handle can be easily checked from the deck even if the handle is located at a high level. Thus, an operator can easily check whether or not the container coupling tool is in engagement.

Other features and objects of the present invention will become apparent from the following description made with reference to the accompanying drawings, in which:

DETAILED DESCRIPTION OF THE PREFERRED EMBODIMENT

Figure 1:
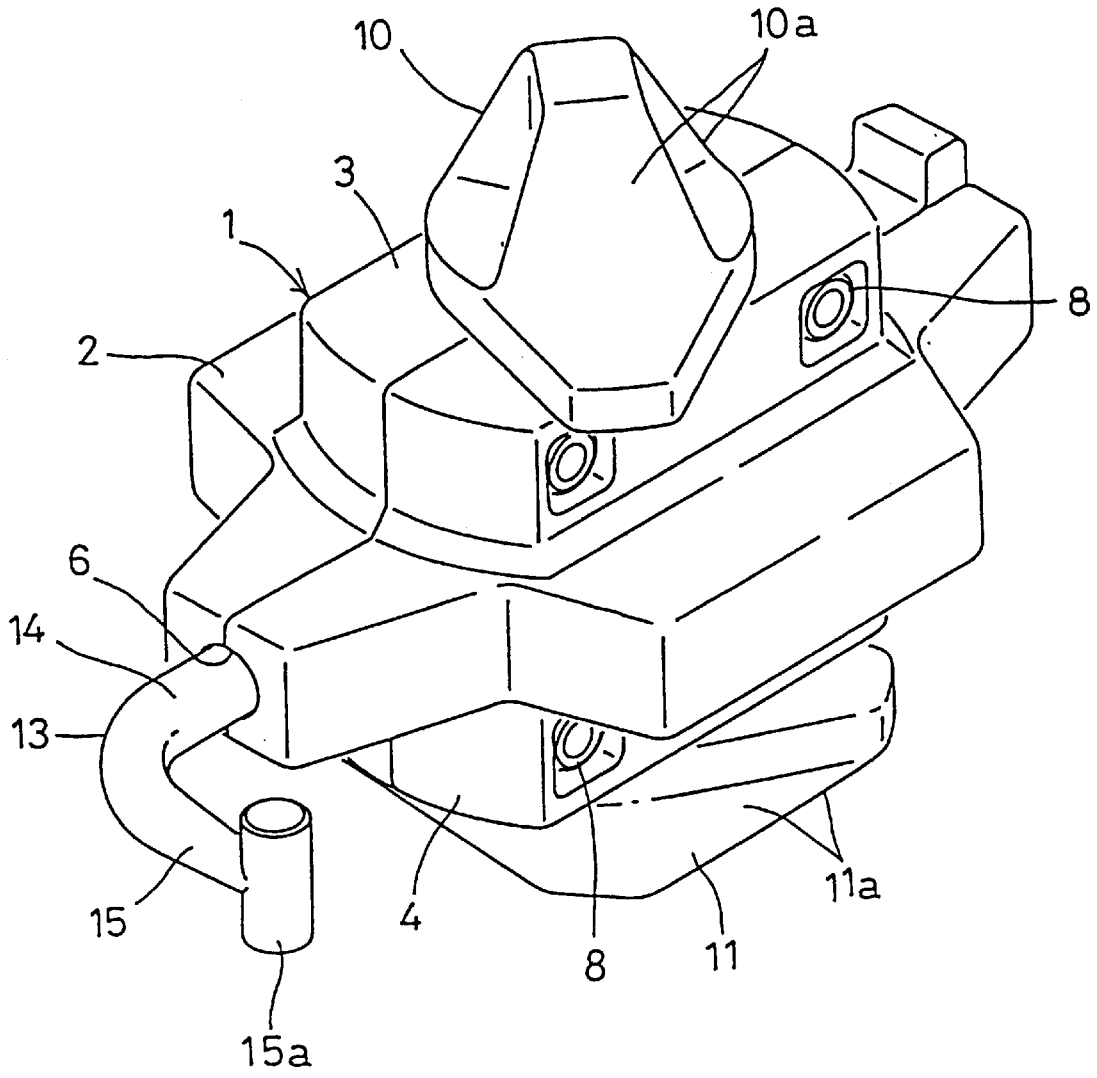
FIG. 1 is a perspective view of a container coupling tool embodying this invention.
Figure 2:
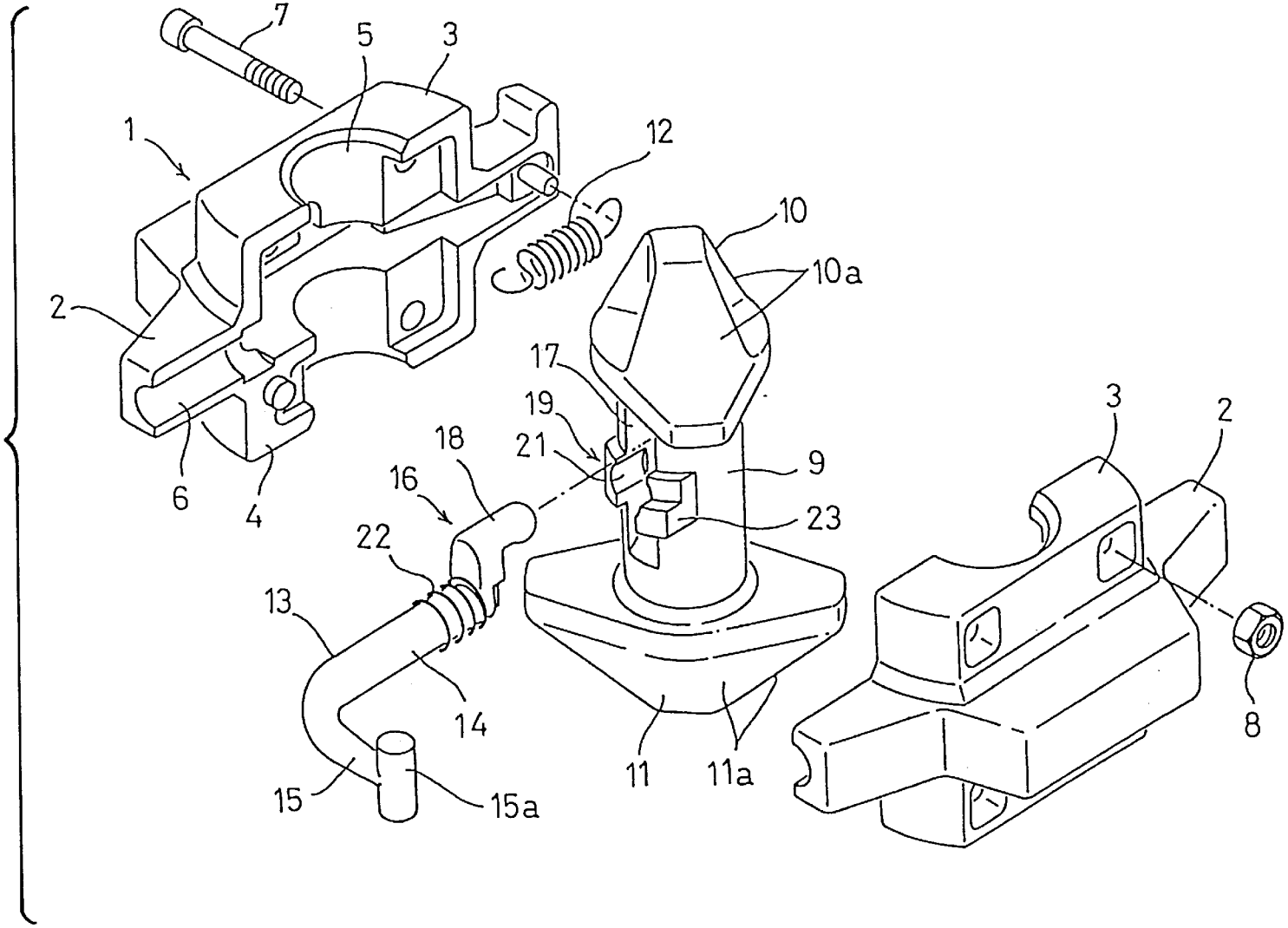
FIG. 2 is an exploded perspective view of the container coupling tool shown in FIG. 1.
Figure 3:
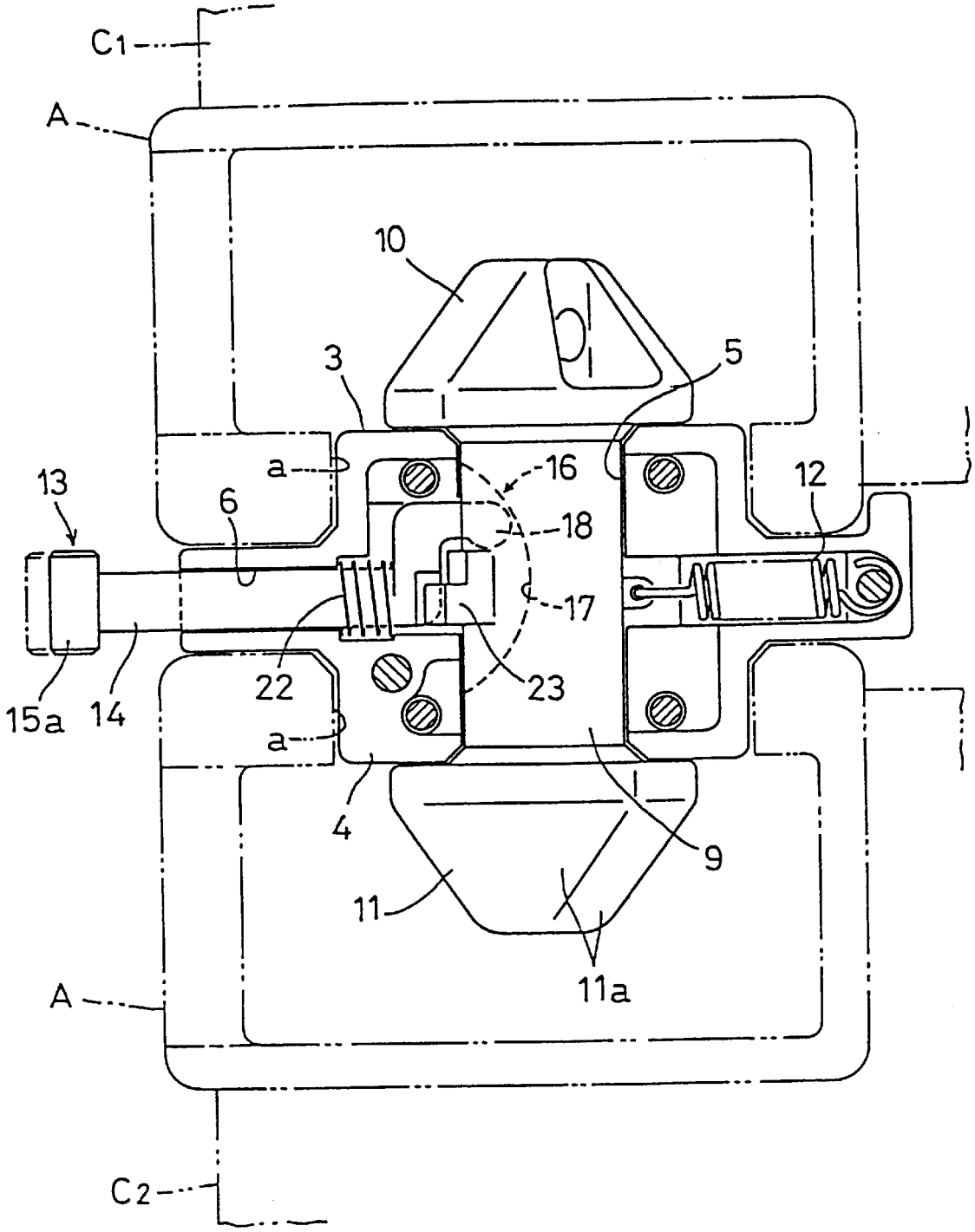
FIG. 3 is a front view in section of the container coupling tool shown in FIG. 1.

First referring to FIGS. 1–4, the coupling tool of the first embodiment has a tool body 1 having a flange 2 that serves as a spacer for maintaining a constant space between two stacked containers, and top and bottom positioning protrusions 3, 4 located over and under the flange 2. The top and bottom protrusions 3, 4 are sized to snugly fit in substantially rectangular holes a formed in corner fixtures A of containers C1, C2 (FIG. 3).

The tool body 1 is formed with a bore 5 extending through the body 1 from the top face of the top protrusion 3 to the bottom face of the bottom protrusion 4, and a handle-receiving hole 6 extending from the outer periphery of the flange 2 to the bore 5.

The tool body 1 comprises two parts split along a vertical plane including the axis of the handle-receiving hole 6 and coupled together by bolts 7 and nuts 8 (FIG. 2).

A rotary shaft 9 is rotatably inserted in the bore 5. It has a top cone 10 at its top end and a bottom cone 11 at its bottom. The top cone 10 and bottom cone 11 are sized such that they are entirely within the perimeter of the top and bottom protrusions 3 and 4 when they are aligned with these protrusions as viewed from top or bottom. The cones 10, 11 have tapered surfaces 10*a*, 11*a* that extend toward their ends. As viewed from top, the cones 10, 11 are not aligned but displaced relative to each other (FIG. 2). A spring 12 is coupled to the shaft 9, which is biased by the spring 12 to a position in which both ends of the cones 10 and 11 protrude from the perimeter of the protrusions 3 and 4, respectively, as viewed from the top (FIG. 1).

The rotary shaft 9 can be rotated by a handle 13. The handle 13 comprises a handle shaft 14 rotatably inserted in the hole 6, and a lever 15 having one end thereof connected to the outer end of the shaft 14 and provided at the other end with a protrusion 15*a* (FIG. 1).

The rotation of the handle 13 is converted to the rotary motion of the rotary shaft 9 by a motion converter 16 comprising a groove 17 formed in the outer periphery of the shaft 9 so as to be elongate in the axial direction of the shaft 9, and an L-shaped arm 18 connected to the inner end of the handle shaft 14 and engaged in the groove 17.

In the rest position (FIG. 1) in which both ends of both cones 10, 11 protrude from the perimeter of the respective protrusions 3, 4, the lever 15 of the handle 13 is in the horizontal position. From this state, when the lever 15 is pushed up into a vertical position, the shaft 9 is rotated to a first disengaged position in which the top cone 10 is entirely within the perimeter of the top protrusion 3. On the other hand, when the lever 15 is pushed down into a vertical position, the shaft is rotated to a second disengaged position where the bottom cone 11 is entirely within the perimeter of the bottom protrusion 4.

In either of the first or second disengaged positions, the shaft 9 and the handle 13 are temporarily locked or retained by a temporary locking or retaining means 19 in the disengaged positions of the top and bottom cones 10, 11, respectively.

The temporarily locking means 19 comprises a pair of cutouts 20 and 21 (FIG. 2) formed in the respective side walls of the groove 17 substantially at the center thereof. In the first and second positions, the end of the arm 18 engages in the cutouts 21 and 20, respectively, thus temporarily locking or retaining the handle 13 and the shaft 9.

The handle shaft 14 is axially movably inserted in the hole 6 and biased toward the bore 5 by a spring 22 mounted on the shaft 14 (FIG. 2).

As shown in FIGS. 2 and 3, a protrusion 23 is formed on the outer periphery of the rotary shaft 9. With the handle shaft 14 pushed axially by the spring 22 to the deepest position, the protrusion 23 faces the rear end of the arm 18. Thus in this state, the protrusion 23 prevents the rotary shaft 9 from rotating toward the first disengaged position by abutting the rear end of the arm 18.

Figure 4:
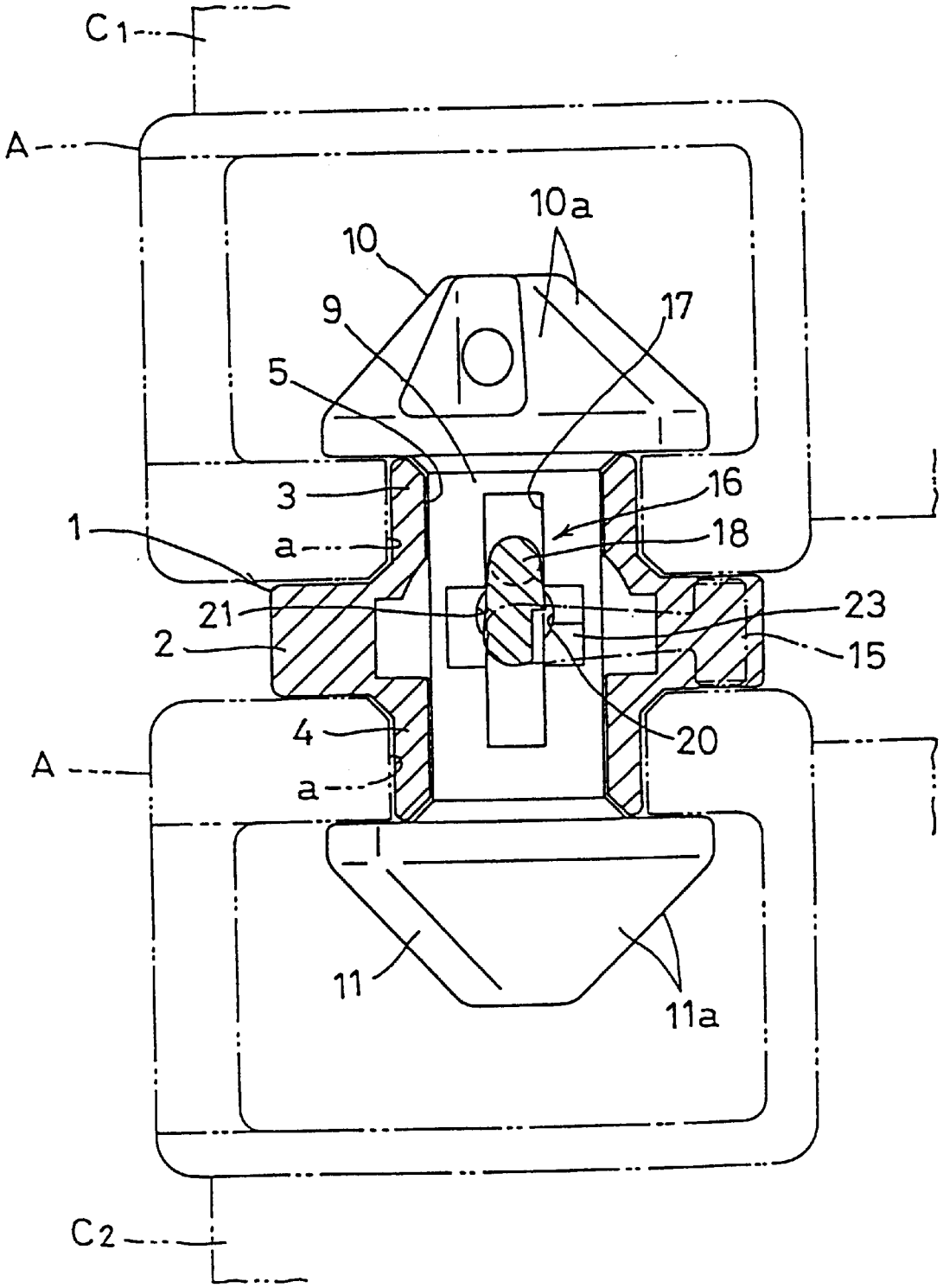
FIG. 4 is a side view in section of the same.

FIGS. 3 and 4 shows how containers C1 and C2 are coupled together by the container coupling tool of the first embodiment. In the state shown, the top cone 10 is in engagement with the upper container with both ends thereof protruding from the perimeter of the top protrusion 3. Specifically, both ends of the top cone 10 are engaged in the hole a formed in the corner fixture A at one bottom corner of the upper container C1.

On the other hand, the bottom cone 11 is engaged in the hole a formed in the corner fixture A at one top corner of the lower container C1 with both ends thereof protruding from the perimeter of the bottom protrusion 3.

In this state, the lever 15 of the handle 13 is in its horizontal position.

Figure 5B:
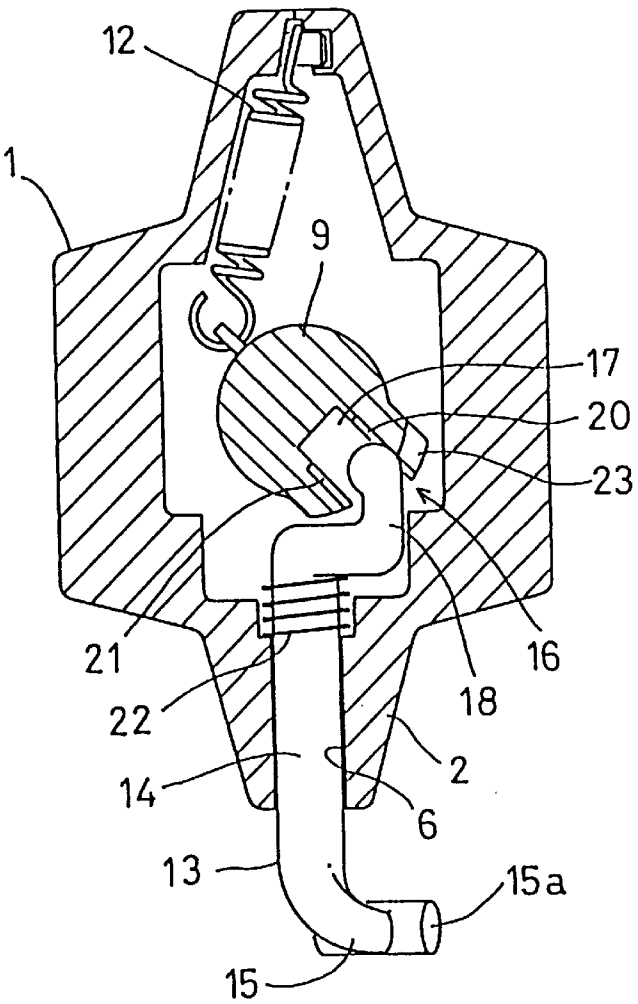
FIG. 5B is a sectional view taken along line V—V of FIG. 5A.
Figure 5A:
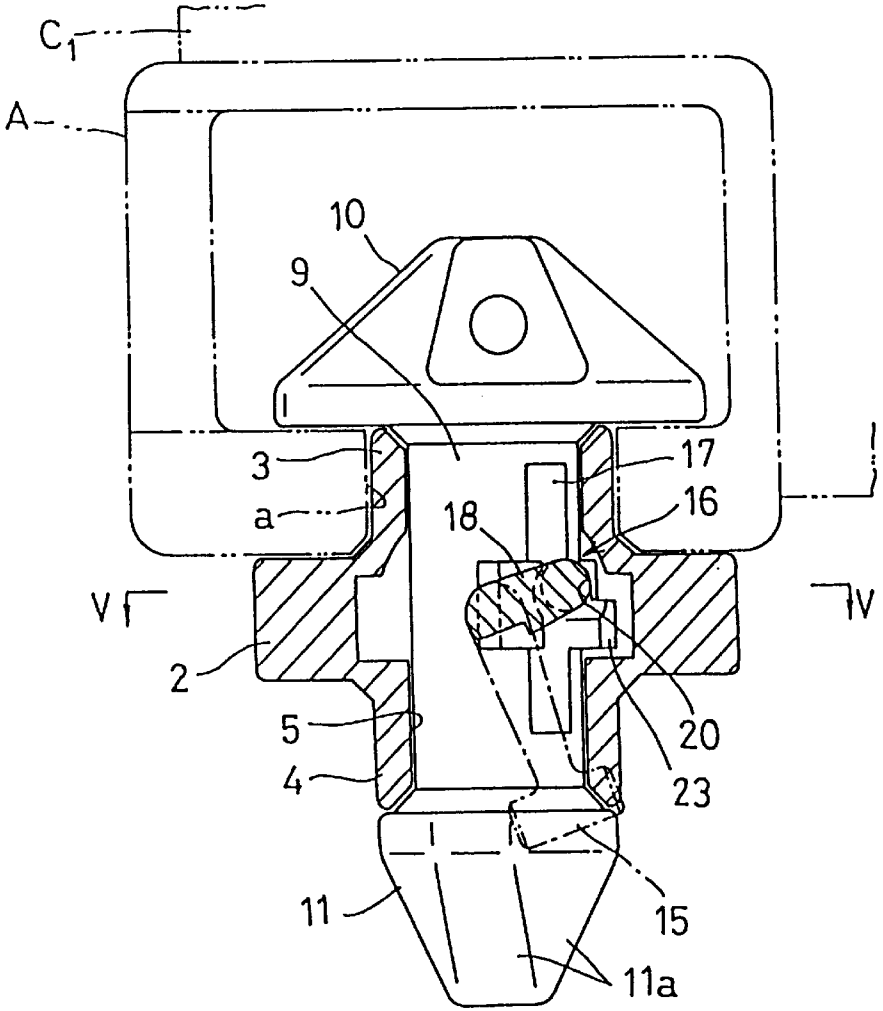
FIG. 5A is a sectional side view of the bottom cone in a disengaged position.

To unload the upper container C1, the lever 15, shown by chain line in FIG. 4, is pulled down to turn the shaft 9 to permit the bottom cone 11 to be disengaged. This turns the handle shaft 14 until the tip of the arm 18 engages in the cutout 20 as shown in FIGS. 5A, 5B. In this state, the bottom cone 11 is entirely within the perimeter of the bottom protrusion 4 and can be thus disengaged from the lower container. With the tip of the arm 18 engaged in the cutout 20, the handle 13 is temporarily locked in position, so that the bottom cone 11 remains in position to be disengaged.

In this state, the top cone 10 is kept engaged in the hole a of the upper container C1. Thus the upper container is raised together with the coupling tool. Since the bottom cone 11 can be disengaged in this state, the bottom cone 11 and the bottom protrusion 4 are pulled out of the hole a of the lower container C2. The containers C1 and C2 are thus separated from each other.

While the upper container C1 is hung in the air, the top cone 10 is engaged in the hole a of the upper container C1 with the lever 15 of the handle 13 turned down. The coupling tool will thus never drop out of the container C1.

Even if the lever 15 should hit something and be turned toward the position in which the top cone 10 disengages while the container C1 is hung in the air, the protrusion 23 of the rotary shaft 9 will abut the rear end of the arm 18, checking further rotation of the handle shaft 14 and the rotary shaft 9. The top cone 10 is thus kept engaged in the hole of the upper container. Thus the coupling tool will never drop from the container C1. People can thus work safely under the container.

Figure 6B:
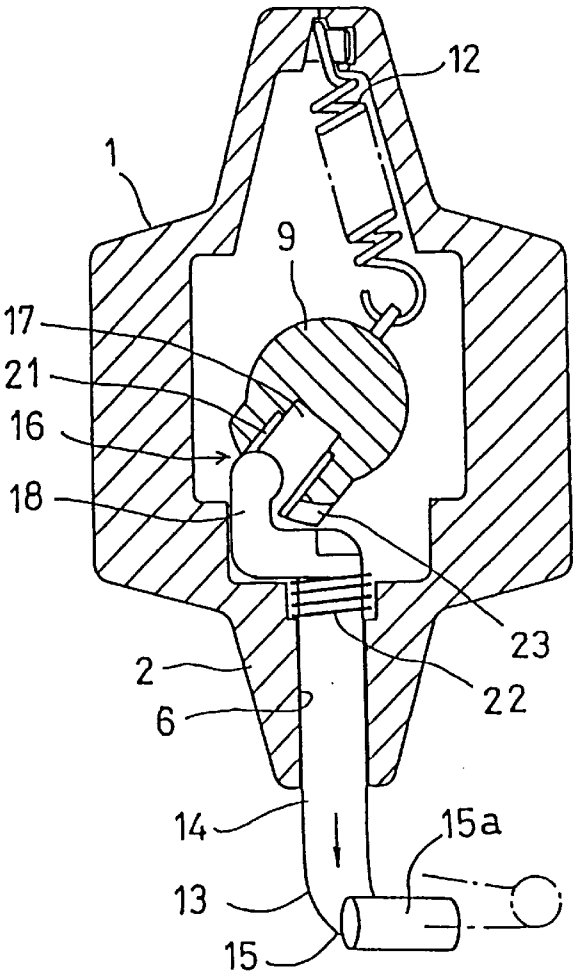
FIG. 6B is a sectional plan view of the top cone of FIG. 6A.
Figure 6A:
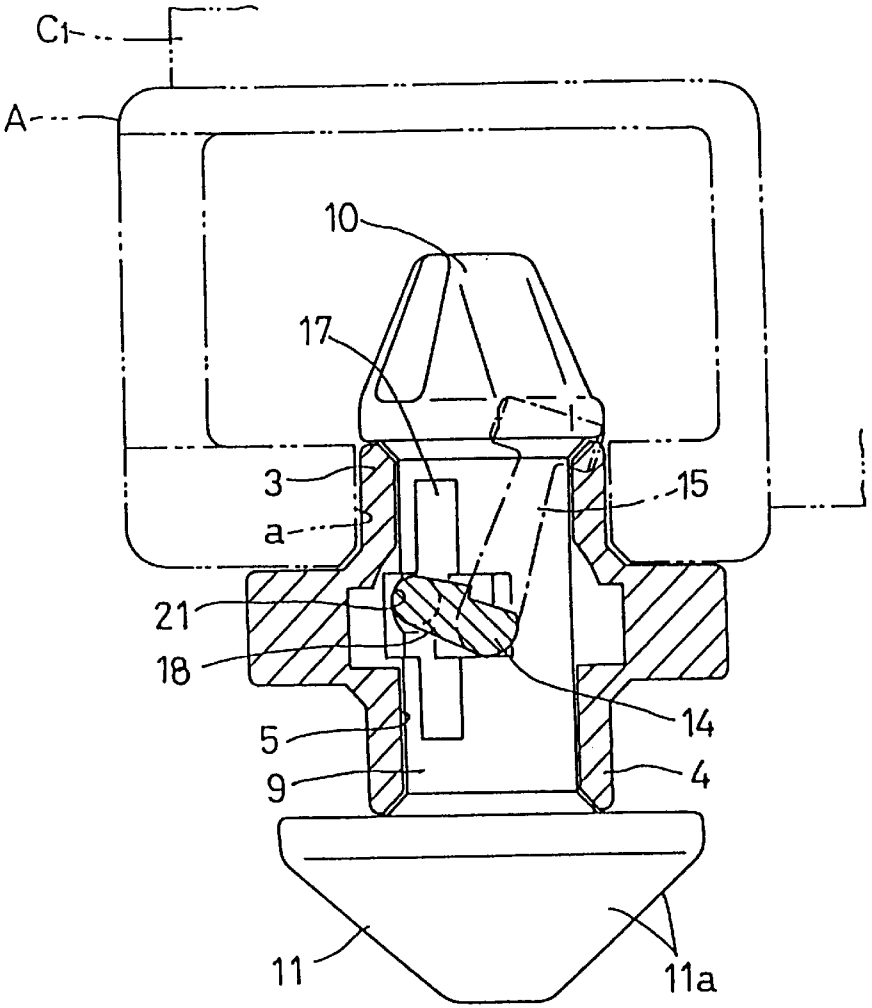
FIG. 6A is a sectional side view of the top cone in a disengaged position.

The container coupling tool is removed from the upper container C1 while the container is hung in the air in the following manner. First, the lever 15 of the handle 13 is moved to its horizontal position. Then, the handle 13 is pulled away from the bore 5 until the rear end of the arm 18 is clear of the protrusion 23. In this state, the lever 15 is pushed up until the tip of the arm 18 engages in the cutout 21 as shown in FIGS. 6A, 6B. In this state, the top cone 10 is turned to the position in which it is entirely within the perimeter of the top protrusion 3. Thus, the top cone drops out of the hole of the upper container by gravity.

When loading the container C1 onto the container C2, with the container C1 hung in the air, the top cone 10 of each container coupling tool is positioned in one of the holes formed in the bottom of the container C1, and the lever is pulled down to its horizontal position to turn the bottom cone 11 to the position in which both ends thereof protrude from the perimeter of the bottom protrusion. In this state, the upper container C1 is landed on the lower container C2 to insert the bottom cone 11 and the bottom protrusion 4 into the hole formed in each top corner of the container C2.

As the bottom cone 11 is pushed into the hole, frictional contact of its tapered surfaces 11*a* along the inner periphery of the hole, causes the cone 11 to turn toward the disengaged position. But when the cone 11 is completely pushed into the hole a, it is turned back to the engaged position by the spring-back force of the spring 12 and engages in the hole.

FIGS. 7–11 show another embodiment of the container coupling tool.

Elements identical or similar to those shown in FIGS. 1–6 are denoted by the same numerals and their description is omitted.

As shown, a handle 13 is rotatably and axially slidably received in a hole 6, and is biased axially outwardly by a spring 30 mounted in a rotary shaft 9.

The handle 13 has an L-shaped arm 18 adapted to abut at its rear end a protrusion 31 formed in the tool body 1 to limit the angle by which the handle 13 can rotate. The tip of the L-shaped arm 18 is adapted to engage in the cutout 20 or 21 slightly before the arm 18 abuts the protrusion 31.

Figure 10:
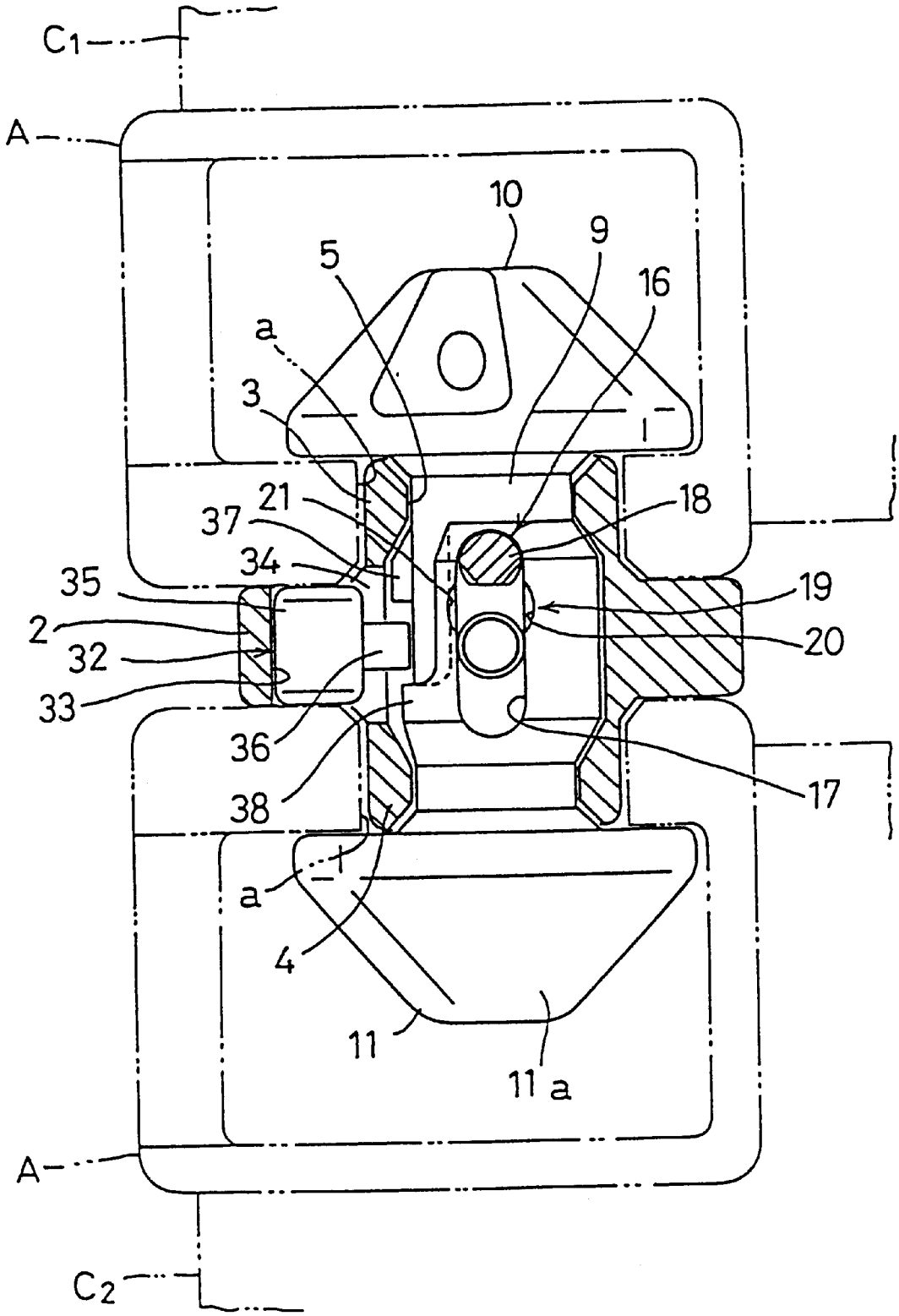
FIG. 10 is a section taken along line X—X of FIG. 8.
Figure 11:
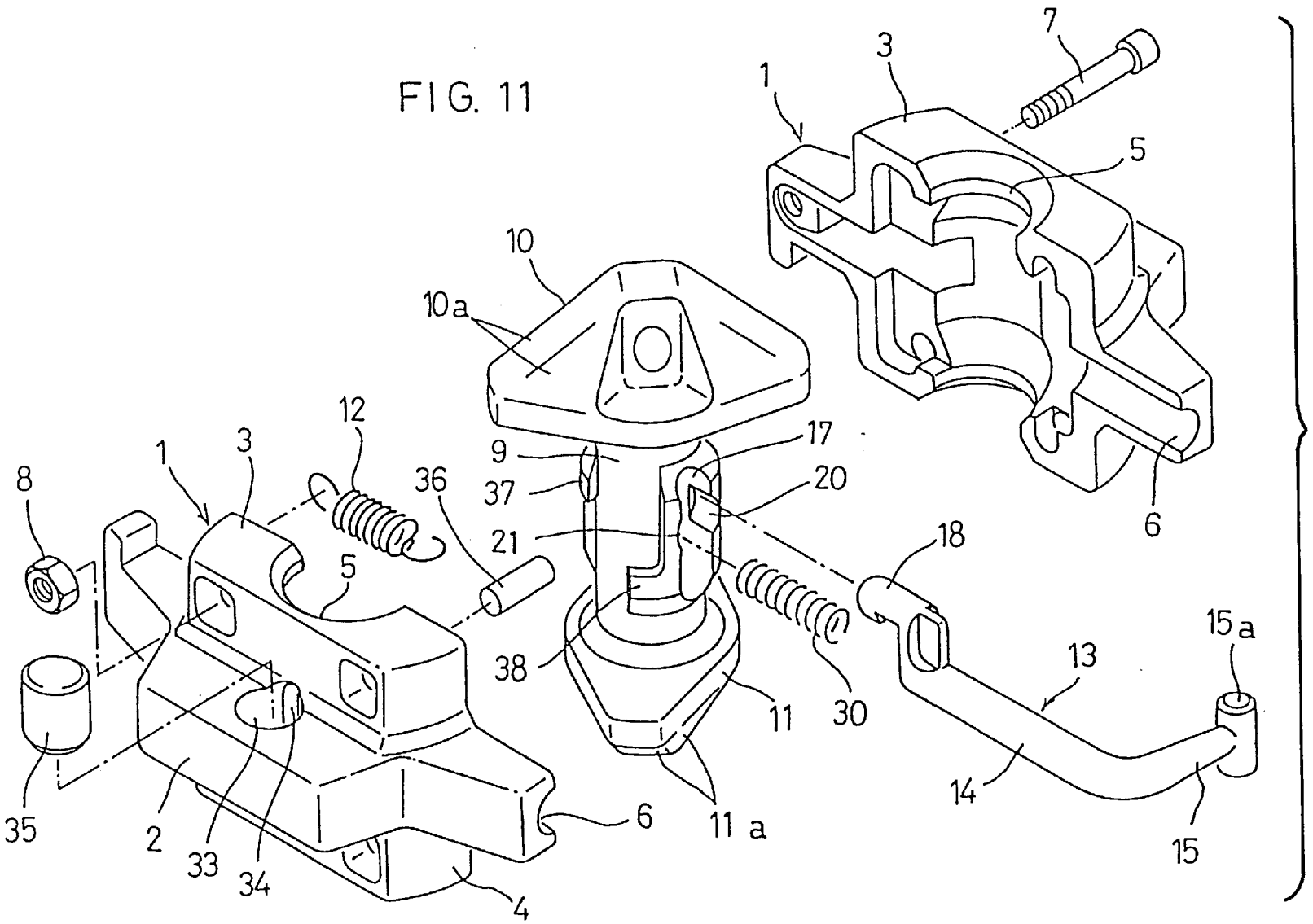
FIG. 11 is an exploded perspective view of the embodiment shown in FIG. 7.

A rotation stopper means 32 shown in FIG. 10 prevents the rotary shaft 9 from rotating from the position in which both ends of the top cone 10 protrude from the perimeter of the top protrusion 3 to the position in which the top cone is entirely within the perimeter of the top protrusion.

The rotation stopper means 32 comprises a hole 33 extending through the flange 2 from its top to bottom surface, a vertically elongate pin hole 34 through which the hole 33 communicates with a bore 5 through which the rotary shaft 9 extends, and a stopper 35 slidably inserted in the hole 33 and having on its outer periphery a stopper pin 36 extending through the pin hole 34 with its tip protruding into the bore 5.

The rotation stopper means 32 further includes first and second protrusions 37 and 38 formed on the rotary shaft 9 at such positions that the stopper pin 36 abuts the first protrusion 37 when the shaft 9 rotates in one direction with the stopper pin 36 at the top end of the pin hole 34, and abuts the second protrusion 38 when the shaft 9 rotates in the other direction with the stopper pin 36 at the bottom end of the pin hole 34.

With this arrangement, when the upper container C1 is coupled to the lower container C2 by the coupling tool as shown in FIG. 10, the stopper 35 is completely retracted or received in the hole 33 with the stopper pin 36 circumferentially opposite to neither of the first and second protrusions 37, 38. Thus, in this state, either the top cone 10 or the bottom cone 9 can be turned to their disengaged position by pushing up or pulling down the lever 15*a* of the handle 13.

Thus, by pulling down the lever 15*a* of the handle, the bottom cone 11 is moved to its disengage position. In this state, by raising the upper container C1, the container coupling tool is raised together with the upper container C1 because the top cone 10 is still in engagement with the upper container.

When the container coupling tool separates from the lower container C2, the stopper 35 will move down relative to the tool body by its own weight until the stopper pin 36 abuts the bottom end of the pin hole. In this state, the stopper pin 36 is located opposite to the second protrusion 38, so that the pin 36 will abut the protrusion 38 if the shaft 9 rotates slightly toward the position in which the top cone 10 disengages, thus preventing further rotation of the shaft 9 in this direction.

Thus, even if the lever 15*a* hits an object and is given a pushing-up force, the lever and thus the shaft 9 cannot be turned all the way but can be turned only until the protrusion 38 abuts the pin 36. The container coupling tool will never drop out of the container C1 while the container is hung in the air. The container C1 can thus be moved safely.

The stopper 35 is slidable in the hole 33 either upward or downward from the position shown in FIG. 10. Thus, the coupling tool operates in exactly the same way if it is positioned upside down between the containers C1 and C2, i.e. with the top cone 10 engaged in the lower container and the bottom cone 11 in the upper container. In this case, when the coupling tool is raised together with the upper container, the stopper 35 lowers to position in which the stopper pin 36 is opposed to the first protrusion 37. In this state, the rotary shaft 9 cannot turn toward the position in which the top cone (cone 11 in this case) disengages. This prevents the fall of the coupling tool from the container. The container tool of this embodiment can thus be used in exactly the same manner when it is positioned upside down.

Figure 7:
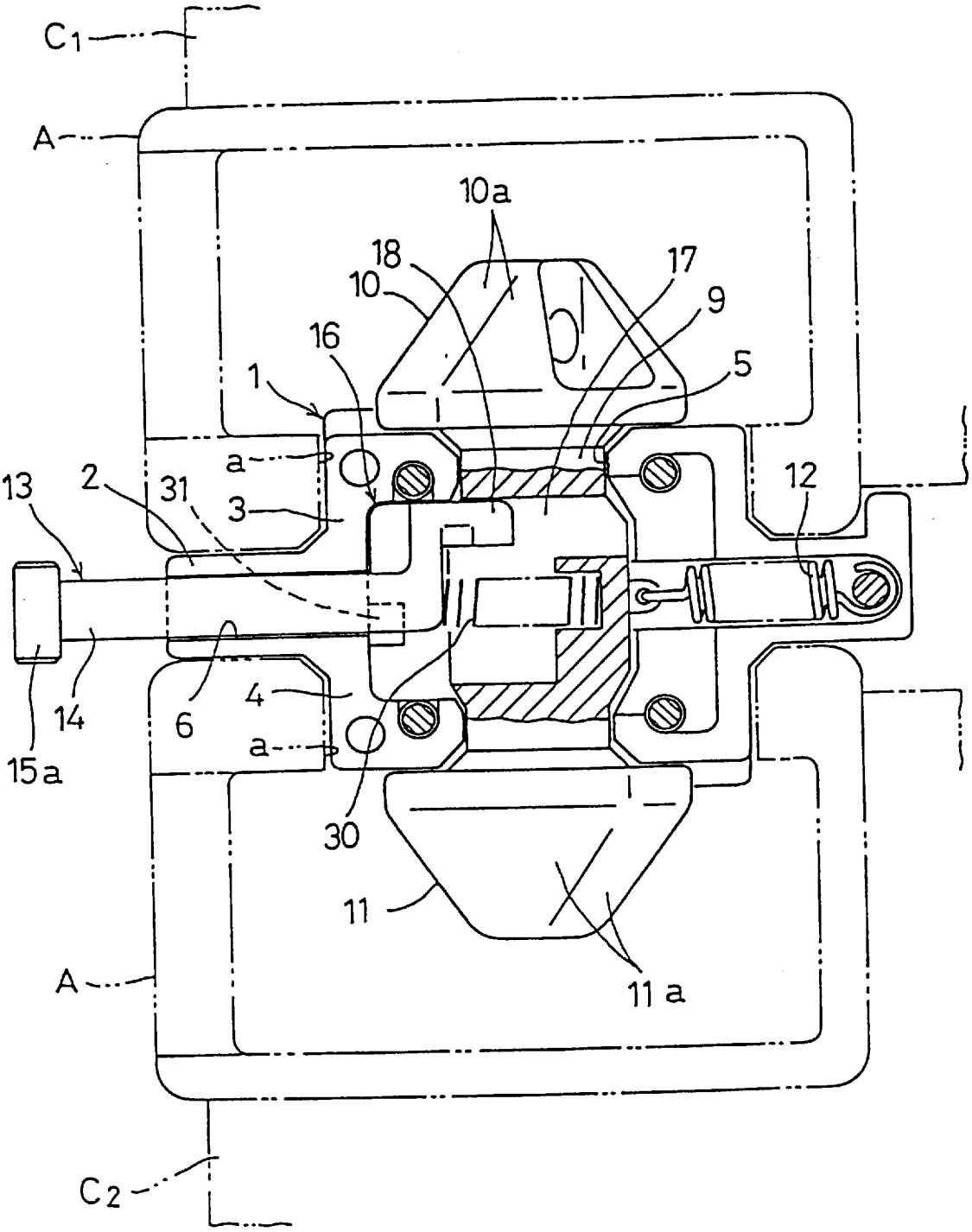
FIG. 7 is a partially cutaway front view of another embodiment.
Figure 8:
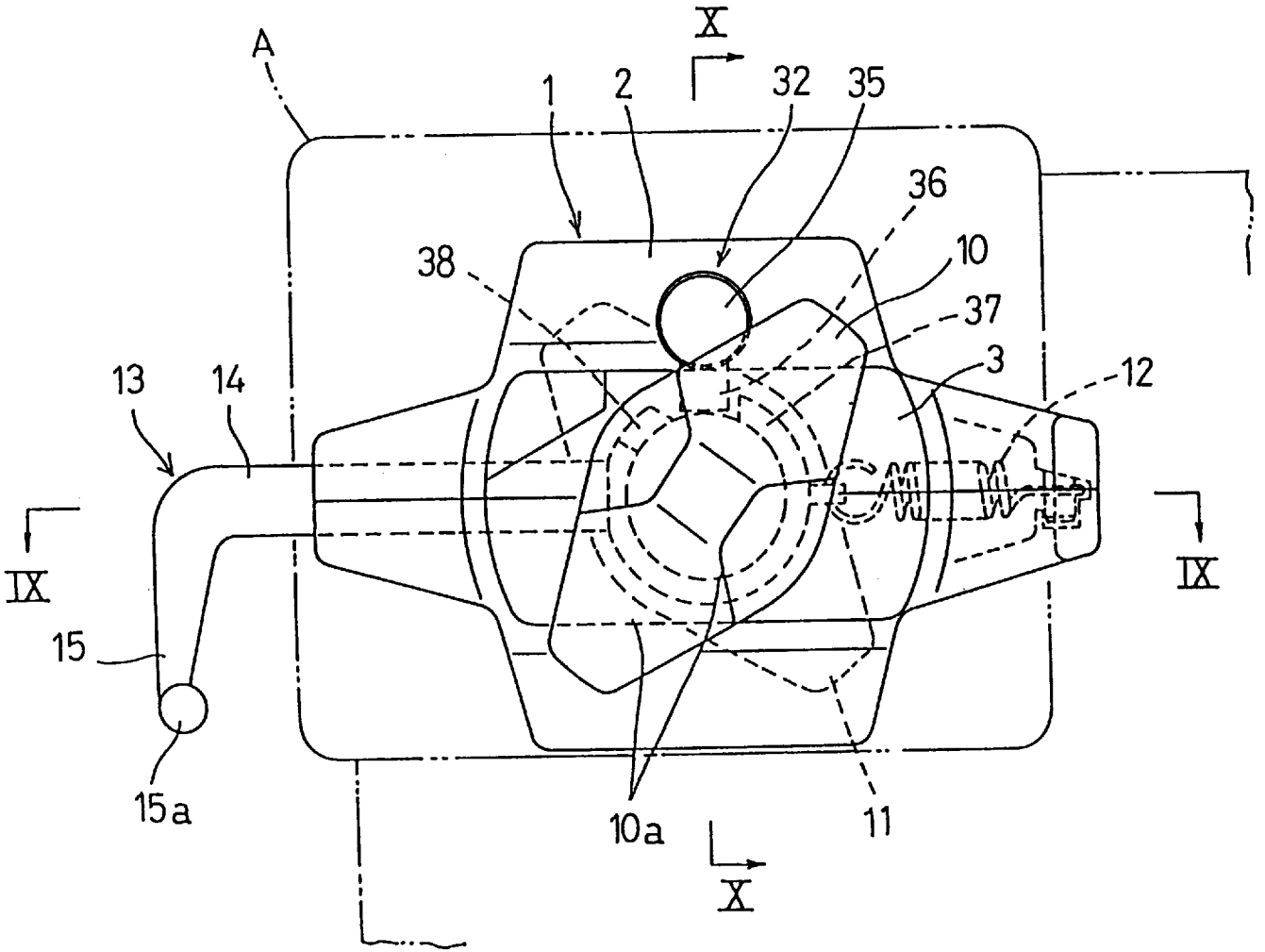
FIG. 8 is a plan view of the embodiment shown in FIG. 7.
Figure 9:
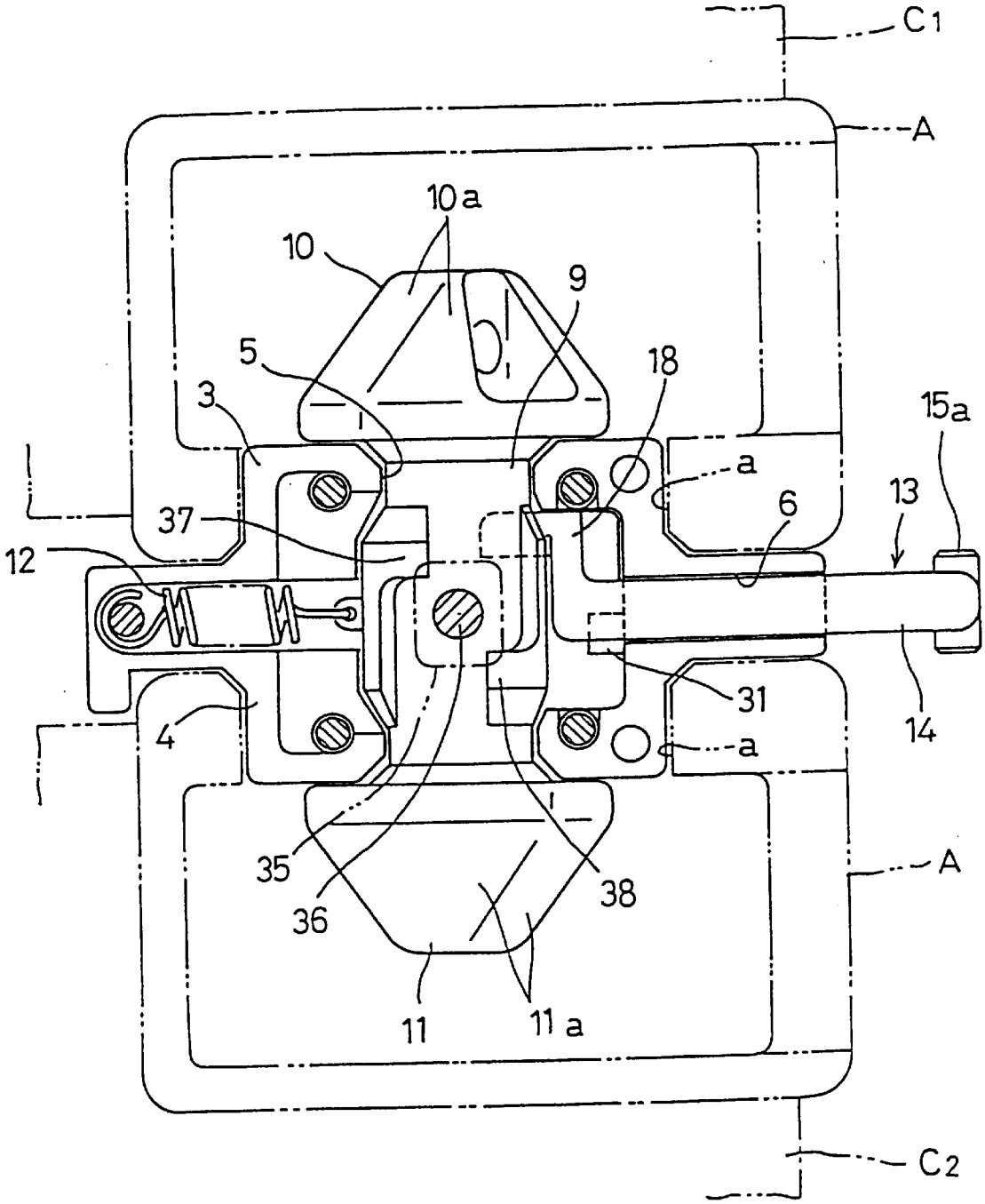
FIG. 9 is a sectional view taken along line IX—IX of FIG. 8.

In the embodiment of FIG. 7, the handle 13 is supported so as to be slidable in the axial direction of the handle shaft 14 and biased outwardly by the spring 30. But the spring 30 may be omitted to rotatably support the handle 13 at a fixed axial position.

As shown in FIG. 7, in the arrangement in which the handle 13 is axially slidably supported and biased outwardly by the spring 30, when tightening tools such as lashing bars or turn buckles are stretched between the corner fittings A of the upper container C1 and deck fittings on the ship deck to stabilize the upper container C1, if the tightening tool abuts the handle 13, the handle 13 moves axially and does not offer a hindrance. Thus, tightening tools may be stretched straight.

According to the present invention, the handle for turning the rotary shaft has a lever. By pushing up the lever from a horizontal position, the top cone disengages, and by pulling it down, the bottom cone disengages. The possibility of errorneously turning the lever in the wrong direction is practically nil. The lever can be easily pulled down or pushed up using e.g. a simple rod having a hook at the tip. No specially designed tool is needed to turn the lever.

Since the handle is an L-shaped member, the orientation of the handle can be easily checked from the deck even if the handle is located at a high level. Thus, an operator can easily check whether or not the container coupling tool is in engagement.

According to the present invention, an operator does not have to keep holding the handle at the position where the top or bottom cone is disengaged when the protrusions are inserted into or pulled out of container holes. The container coupling tool can thus be easily coupled to or detached from a container.

Further, according to the present invention, the handle cannot be turned unless the handle shaft is moved outwardly by pulling the lever until the rear end of the arm separates from the protrusion formed on the outer periphery of the rotary shaft. Thus, coupling tools coupled to a container hung in the air will never spontaneously drop off the container. Containers can thus be loaded and unloaded safely.

Further, according to the present invention, the container coupling tool will not drop off a container even if it is used in an upside down orientation.

What is claimed is:

1. A container coupling tool comprising:

a tool body having a flange for maintaining a predetermined space between two containers that are stacked one on the other, and a pair of positioning protrusions provided over and under said flange, respectively, said tool body having a bore extending from an outer surface of one of said positioning protrusions to an outer surface of the other of said positioning protrusions, wherein said positioning protrusions are adapted to fit in substantially rectangular holes formed in corner fixtures of the containers;

a rotary shaft received in said bore, said rotary shaft having a top end and a bottom end;

a top cone connected to the top end of said rotary shaft, said top cone being engagable in the rectangular holes formed in the containers;

a bottom cone connected to the bottom end of said rotary shaft, said bottom cone being engagable in the rectangular holes formed in the containers;

a spring for biasing said rotary shaft to an engage position in which ends of each of said top and bottom cones protrude beyond the perimeters of said top and bottom protrusions, respectively, said spring being mounted so as to be expanded when said rotary shaft is rotated away from the engage position;

a handle having a handle shaft inserted in a hole formed in said tool body so as to extend horizontally from the outer periphery of said flange to said bore, a lever extending laterally from an outer end of said handle shaft, and a motion converter for transmitting rotation of said handle shaft to said rotary shaft such that, when said lever is pushed up from a horizontal position, said top cone is turned to a disengage position, and when said lever is pulled down from the horizontal position, said bottom cone is turned to a disengage position, and when said lever is moved to the horizontal position both of said upper and lower cones are in engage positions.

2. A container coupling tool as claimed in claim 1, further comprising a temporary retaining means for temporarily retaining said rotary shaft in a position which corresponds to the disengage position of said top cone, and in a position which corresponds to the disengage position of said bottom cone.

3. A container coupling tool as claimed in claim 1, wherein said motion converter comprises an axial groove formed in an outer periphery of said rotary shaft, and an L-shaped arm provided at the inner end of said handle shaft, said L-shaped arm having a tip that is engaged in said axial groove.

4. A container coupling tool as claimed in claim 3, further comprising:

a protrusion is formed on the outer periphery of said rotary shaft so as to oppose one side of said L-shaped arm and prevent said rotary shaft from turning to the position corresponding to the disengage position of said top cone, wherein said handle shaft is axially movable between a first position in which said one side of said L-shaped arm is located opposite said protrusion, and a second position in which said L-shaped arm can rotate past said protrusion; and a spring biasing said handle shaft axially toward the first position of said rotary shaft.

5. A container coupling tool as claimed in claim 1, wherein said handle shaft has a longitudinal axis, said handle is slidable in a direction of the longitudinal axis of said handle shaft, and said tool body is formed with a stopper hole extending through said flange and a vertically elongated pin hole extending between said stopper hole and said bore, said container coupling tool further comprising:

a spring for biasing said handle outwardly along the direction of the longitudinal axis of said handle shaft;

a stopper slidably inserted in said stopper hole, said stopper having a stopper pin received in said elongated pin hole so that an end of said stopper pin protrudes into said bore; and first and second projections provided on the outer periphery of said rotary shaft, wherein said first projection is positioned to oppose said stopper pin when said stopper pin is located at a first end of said elongated pin hole, and said second projection is positioned to oppose said stopper pin when said stopper pin is located at a second end of said elongated pin hole.

6. A container coupling tool as claimed in claim 1, wherein said first and second projections are located on the outer periphery of said rotary shaft so as to be circumferentially and longitudinally spaced from each other.

7. A container coupling tool as claimed in claim 2, wherein said motion converter comprises an axial groove formed in an outer periphery of said rotary shaft, and an L-shaped arm provided at the inner end of said handle shaft, said L-shaped arm having a tip that is engaged in said axial groove.

* * * * *